US007055573B2

(12) United States Patent
Martin

(10) Patent No.: US 7,055,573 B2
(45) Date of Patent: Jun. 6, 2006

(54) SYSTEMS AND METHODS FOR REDUCING GAP SPACE BETWEEN DOOR SECTIONS

(75) Inventor: Kenneth David Martin, Sandy, UT (US)

(73) Assignee: Martin Door Manufacturing, Salt Lake City, UT (US)

( * ) Notice: Subject to any disclaimer, the term of this patent is extended or adjusted under 35 U.S.C. 154(b) by 0 days.

(21) Appl. No.: 10/422,434

(22) Filed: Apr. 24, 2003

(65) Prior Publication Data

US 2003/0230390 A1 Dec. 18, 2003

Related U.S. Application Data

(60) Provisional application No. 60/376,173, filed on Apr. 25, 2002.

(51) Int. Cl.
*E05D 15/24* (2006.01)

(52) U.S. Cl. ..... 160/201; 160/229.1

(58) Field of Classification Search ..... 160/201, 160/229.1, 40, 232, 213, 405
See application file for complete search history.

(56) References Cited

U.S. PATENT DOCUMENTS

| | | | | |
|---|---|---|---|---|
| 2,315,488 A | | 4/1943 | Aldeen | 29/11 |
| 2,504,351 A | | 4/1950 | Ring | 16/142 |
| 3,103,967 A | | 9/1963 | Gaschen | 160/113 |
| 3,198,242 A | | 8/1965 | Crosswell | 160/190 |
| 3,227,205 A | * | 1/1966 | Crosswell | 160/40 |
| 3,302,690 A | | 2/1967 | Hurd | 160/40 |
| 3,302,692 A | | 2/1967 | Grau | 160/133 |
| 3,319,697 A | | 5/1967 | Krohn | 160/229 |
| 3,891,021 A | | 6/1975 | Geoffrey | 160/235 |
| 3,894,654 A | | 7/1975 | Frankenberg | 220/283 |
| 3,941,180 A | | 3/1976 | Thill | 160/229 R |
| 3,967,671 A | | 7/1976 | Stanley et al. | 160/232 |
| 4,269,253 A | | 5/1981 | Ziegler | 160/201 |
| 4,518,026 A | | 5/1985 | Otto et al. | 160/232 |
| 4,736,785 A | | 4/1988 | Seuster | 160/264 |

(Continued)

FOREIGN PATENT DOCUMENTS

AU 0 666 402 A1 8/1995

(Continued)

OTHER PUBLICATIONS

"Hinges by Braun," 1975, Braun Manufacturing Company, Inc., 1657 North Kostner Ave., Chicago, IL 60639, 9 pages, Catalog No. 155.

(Continued)

*Primary Examiner*—David Purol
(74) *Attorney, Agent, or Firm*—Berne S. Broadbent; Kirton & McConkie

(57) ABSTRACT

Systems and methods for reducing gap space between sections to enhance safety and to enable one section of the door to support the weight of another. An overhead door having a variety of sections comprises a first section that includes a contour and a corresponding second section that includes a surface, wherein the surface corresponds to the contour so that as the sectional door follows a track system the surface follows the contour to maintain a joint gap within a particular range between the surface and the contour to prevent or reduce the risk of injury due to the joint gap. A pivot point of a hinge used to secure the first section to the second section is located between the first and second panels. The opposing surfaces of the first and second sections touch the hinge, without causing the hinge to bind when in use.

20 Claims, 8 Drawing Sheets

U.S. PATENT DOCUMENTS

| | | | | | |
|---|---|---|---|---|---|
| 4,771,508 | A | | 9/1988 | Lautenschlager, Jr. | 16/370 |
| 4,771,816 | A | | 9/1988 | Clay, Jr. | 160/235 |
| 4,893,666 | A | | 1/1990 | Hormann | 160/229.1 |
| 4,924,932 | A | | 5/1990 | Esnault | 160/201 |
| 4,989,660 | A | | 2/1991 | Wagner | 160/201 |
| 5,002,114 | A | | 3/1991 | Hormann | 160/229.1 |
| 5,170,832 | A | * | 12/1992 | Wagner | 160/201 |
| 5,359,812 | A | | 11/1994 | Mayfield | 49/383 |
| 5,419,084 | A | | 5/1995 | Sankey et al. | 49/383 |
| 5,555,923 | A | | 9/1996 | Leist et al. | 160/229.1 |
| 5,564,164 | A | | 10/1996 | Jella | 16/355 |
| 5,669,431 | A | | 9/1997 | Druzynski et al. | 160/229.1 |
| 5,709,259 | A | | 1/1998 | Lewis et al. | 160/201 |
| 5,782,283 | A | | 7/1998 | Kendall | 160/229.1 |
| 5,921,307 | A | | 7/1999 | Ford et al. | 160/229.1 |
| 5,934,352 | A | | 8/1999 | Morgan | 160/201 |
| 6,015,003 | A | | 1/2000 | Switzgable | 160/201 |
| 6,041,478 | A | | 3/2000 | Martin | 16/385 |
| 6,047,761 | A | | 4/2000 | Jachnen et al. | 160/201 |
| 6,062,293 | A | | 5/2000 | Berger, Jr. | 160/229.1 |
| 6,073,674 | A | | 6/2000 | Hormann | 160/201 |
| 6,076,590 | A | | 6/2000 | Ford et al. | 160/229.1 |
| 6,148,896 | A | | 11/2000 | Pinto et al. | 160/229.1 |
| 6,328,091 | B1 | | 12/2001 | Whitley | 160/201 |
| 6,330,901 | B1 | | 12/2001 | Friesen et al. | 160/201 |
| 6,397,919 | B1 | | 6/2002 | Lamsfuss | 160/201 |
| 6,408,926 | B1 | | 6/2002 | Hoofard et al. | 160/236 |
| 6,527,036 | B1 | | 3/2003 | Welsh | 160/201 |
| 6,578,619 | B1 | * | 6/2003 | Wright | 160/229.1 |

FOREIGN PATENT DOCUMENTS

| | | | |
|---|---|---|---|
| DE | 216816 | | 1/1908 |
| DE | 631 715 | | 6/1936 |
| DE | 2106063 | | 8/1971 |
| DE | 0 030 086 | A1 | 6/1981 |
| DE | 378 237 | | 7/1985 |
| DE | 0 304 642 | B1 | 1/1990 |
| DE | 0 370 376 | B1 | 5/1990 |
| DE | 0 394 491 | A2 | 10/1990 |
| DE | 0 608 683 | A2 | 8/1994 |
| DK | 0436/93 | L | 10/1994 |
| EP | 0 623 724 | A1 | 11/1994 |
| EP | 0 661 185 | A1 | 7/1995 |
| FI | 93762 | | 5/1990 |
| FI | 178443 | | 12/1995 |
| FR | 1.396.317 | | 3/1965 |
| WO | WO 95/24536 | | 9/1995 |
| WO | WO 95/34738 | | 12/1995 |

OTHER PUBLICATIONS

Advertisement: "Martin Finger Shield Garage Door System," 1999, Martin Door Manufacturing, Salt Lake City, UT 84127-0437, 16 pages.

Article: "Knuckles, Ships, and Tongues," 1 page, Eckert Door Company, Inc., 6510 W. State St., Milwaukee, WI 53213.

* cited by examiner

SYSTEMS AND METHODS FOR REDUCING GAP SPACE BETWEEN DOOR SECTIONS

RELATED APPLICATIONS

This application claims priority to U.S. Patent Application Ser. No. 60/376,173 filed Apr. 25, 2002, entitled SYSTEMS AND METHODS FOR REDUCING GAP SPACE BETWEEN DOOR SECTIONS.

BACKGROUND OF THE INVENTION

1. Field of the Invention

The present invention relates to sectional doors having a relationship and structure of and between door sections to enhance the safety and strength of the sectional doors. More particularly, the present invention relates to systems and methods for reducing gap space between sections of a door to enhance safety and to enable one section to support the weight of another section, wherein the support is beyond the strength of the hinge coupled to the two sections.

2. Background and Related Art

Sectional doors are commonly referred to as "overhead doors" or "garage doors," and are designated by such names by reason of their operation. Sectional doors are designed to selectively provide closure for a garage opening, such as an automotive garage opening associated with a home. In order to accommodate the closure of the opening, the sectional door is typically assembled from a plurality of horizontally oriented door sections having a length that spans the opening.

With reference to FIG. 1A, sectional doors, such as door 10, traditionally include a hinge 12 that causes the joint between sections of the door to open and form a gap 14 as the door is opened. Surface 15 is illustrated as the front surface of the sectional door.

The sections are hinged edge to edge to create the sectional door. The ends of the sections are supported and the movement thereof is directed by a track system that is mounted on each end of the sectional door.

Regrettably, thousands of tragedies have occurred in association with traditional sectional doors due to the formation of gap 14. As illustrated in FIG. 1B, gap 14 enables fingers 16 to be trapped, pinched, or otherwise injured. The injury may occur at the front of gap 14, as illustrated by fingers 16*a*, or at the back of gap 14, as illustrated by fingers 16*b*. The severity of the injury is typically related to the weight of the door. Thus, for example, the entrapment of fingers in a joint gap of a wooden sectional door can break bones, amputate fingers, and/or permanently maim a user. Accordingly, it would be an advancement in the art to augment or even replace current designs and techniques with other techniques to prevent or at least reduce the potential for injury.

SUMMARY OF THE INVENTION

The present invention relates to sectional doors having a relationship and structure of and between door sections to enhance the safety and strength of the sectional doors. More particularly, the present invention relates to systems and methods for reducing gap space between sections of a door to enhance safety and to enable one section to support the weight of another section, wherein the support is beyond the strength of the hinge coupled to the two sections.

Implementation of the present invention takes place in association with an overhead door that includes a variety of sections, wherein one section is designed to support the weight of another section, and wherein the gap space between sections is minimized to reduce the risk of injury. In one implementation, a first section includes a contour and a corresponding second section includes a surface, wherein the surface corresponds to the contour so that as the sectional door follows a track system the surface follows the contour to maintain a joint gap within a particular range between the surface and the contour to prevent or reduce the risk of injury due to the joint gap. In a further implementation, a pivot point of a hinge used to secure the first section to the second section is in line with the back plane of the door and includes at least a portion thereof between the first and second panels, thereby allowing opposing surfaces of the first and second sections to touch the hinge, without causing the hinge to bind when in use.

In one implementation of the present invention, section door comprises wood. One such sectional door has the appearance of a traditional "Carriage House" door, which resembles a barn door style of the $19^{th}$ Century that has the appearance of swinging open. While the methods and processes of the present invention have proven to be particularly useful in the area of wooden Carriage House sectional doors, those skilled in the art can appreciate that the methods and processes can be used in a variety of different applications to reduce the gap space between the outside and inside sections of a door.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to sectional doors having a relationship and structure of and between door sections to enhance the safety and strength of the sectional doors. More particularly, the present invention relates to systems and methods for reducing gap space between sections of a door to enhance safety and to enable one section to support the weight of another section, wherein the support is beyond the strength of the hinge coupled to the two sections.

Embodiments of the present invention take place in association with an overhead door that includes a variety of sections, wherein a first section is designed to support the weight of another section, and wherein the gap space between sections is reduced to prevent the risk of injury. In one embodiment, a first section includes a contour and a corresponding second section that is configured to be associated with the first section includes a surface. The surface corresponds to the contour so that as the sectional door follows a track system to allow for the door to be raised or lowered, the surface follows the contour to maintain a joint gap within a particular range between the surface and the contour to prevent or reduce the risk of injury due to the joint gap.

In a further embodiment, at least a portion of a pivot point of the hinge, which is used to secure the first and second sections together and to allow for the sections to pivot in relation to each other, is located between the first and second panels, thereby allowing opposing surfaces of the first and second sections to touch the hinge, without causing the hinge to bind when in use, as will be further explained below.

Figure 1B:
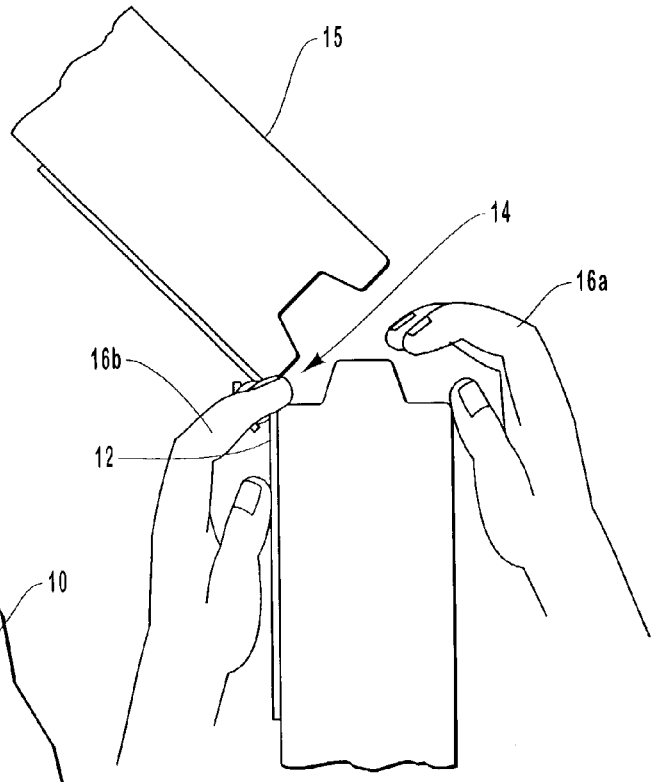
Fig. 1B (PRIOR ART)
FIG. 1B provides side view of the traditional joint gap of FIG. 1A.
Figure 1A:
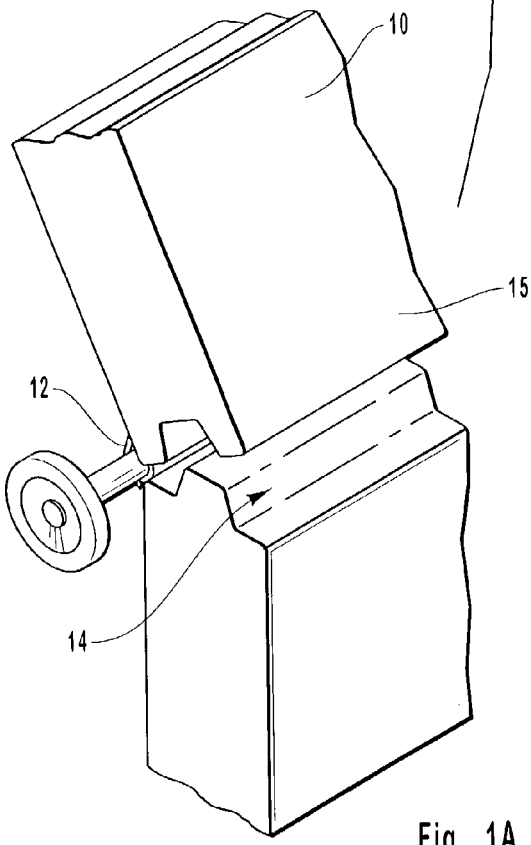
Fig. 1A (PRIOR ART)
FIG. 1A provides a representative joint gap created by a traditional sectional door.
Figure 2:
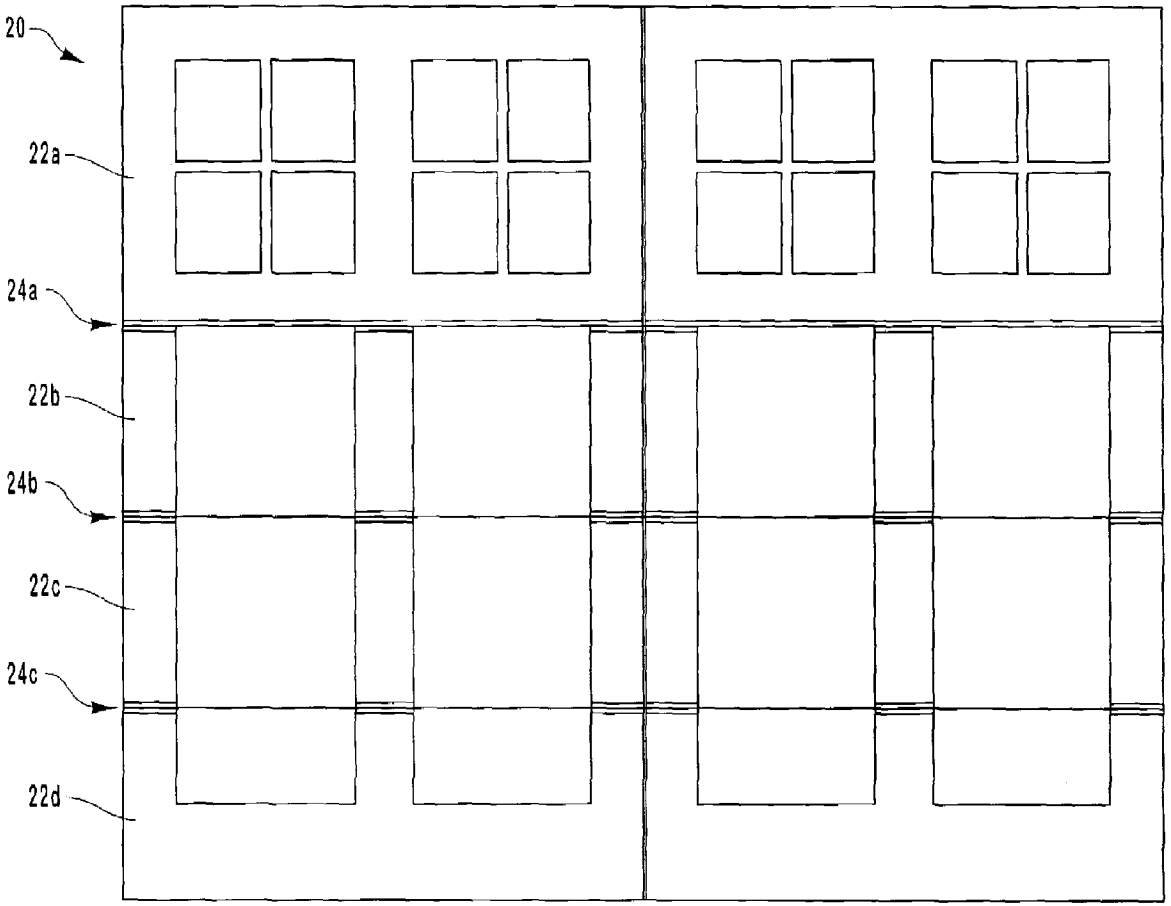
FIG. 2 provides a front view of a representative sectional door in accordance with the present invention.

With reference now to FIG. 2, an illustration is provided of a front view of a representative sectional door in accordance with the present invention. Sectional doors may comprise metal, wood, plastic, or another material, and may include a variety of aesthetically pleasing designs. For example, FIG. 2 provides sectional door 20 having a carriage house door design, which is designed to mimic a barn door appearance. In one embodiment of the present invention, the aesthetic design is carved into or otherwise a part of the various sections of the door. In another embodiment, an appliqué is mounted onto the front surface of the sectional door.

Door 20 includes a variety of horizontal panels 22 and corresponding joints 24. In the illustrated embodiment, door 20 is designed so that a first panel (e.g., panel 22*d*) supports the weight of a corresponding panel (e.g., panel 22*c*). Joints 24 allow for door 20 to follow a curvature in a track system that allows for door 20 to be selectably raised or lowered.

Figure 3:
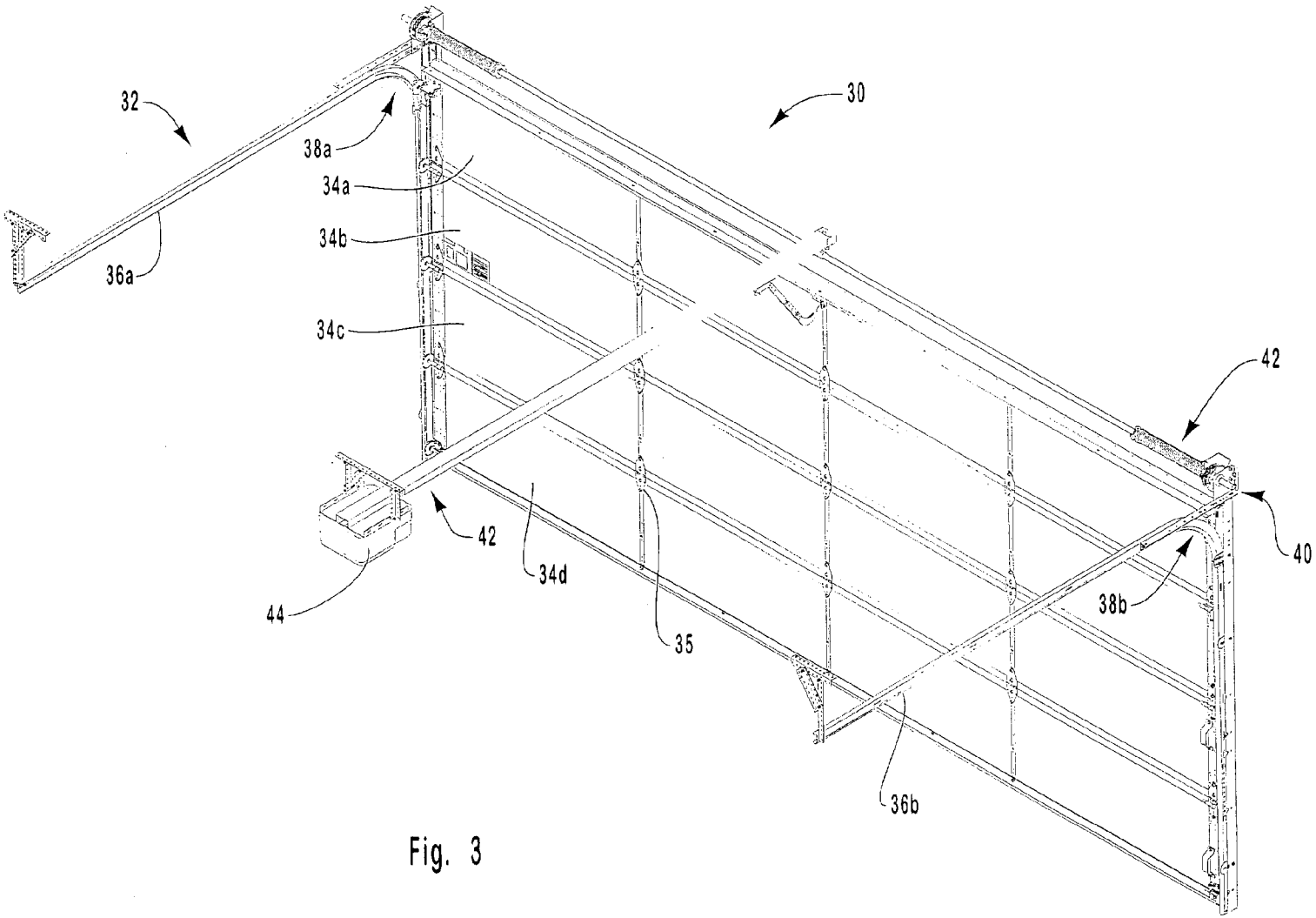
FIG. 3 provides a perspective rear view of a sectional door in accordance with the present invention, including a system that allows the door to be selectively raised or lowered.

With reference now to FIG. 3, an illustration is provided of a perspective rear view of sectional door 30, which includes a track system 32 that allows the door to be selectively raised or lowered. Sections 34 are hingedly joined to create the door. In the illustrated embodiment, hinge 35 is a low profile hinge that is installed in a reverse position with the pivot in board. The ends of the door sections are supported and the movement thereof is directed by track system 32, which is mounted on each end of the sectional door. The tracks 36 are in a vertical orientation to support the sectional door in its vertical or closed position, and a horizontal orientation to support the sectional door in its open position. A curved section 38 of track 36 accommodates the transition between the vertical and horizontal orientations. The hinged relationship between adjacent door sections allows the sectional door 30 to traverse a curved portion of the track between the vertical (closed) position to the overhead (open) position. The sectional door is moved between the vertical (closed) orientation and the overhead (open) configuration with the orientation thereof being controlled by the supportive tracks 36.

In the illustrated embodiment, the track system 32 includes a mounting system 40 to mount door 30 to track system 32 and a lifting system 42, which optionally includes a motor 44 to selectively raise or lower the door. By way of example, in one embodiment, mounting system 40 includes hinges, rollers, fasteners, and a track. A lifting system 42 inlcudes springs, cable drums, a cable, brackets, bearing plates, and optionally a motor to provide the motive force or the sectional door can alternatively be raised/lowered manually.

Figure 4A:
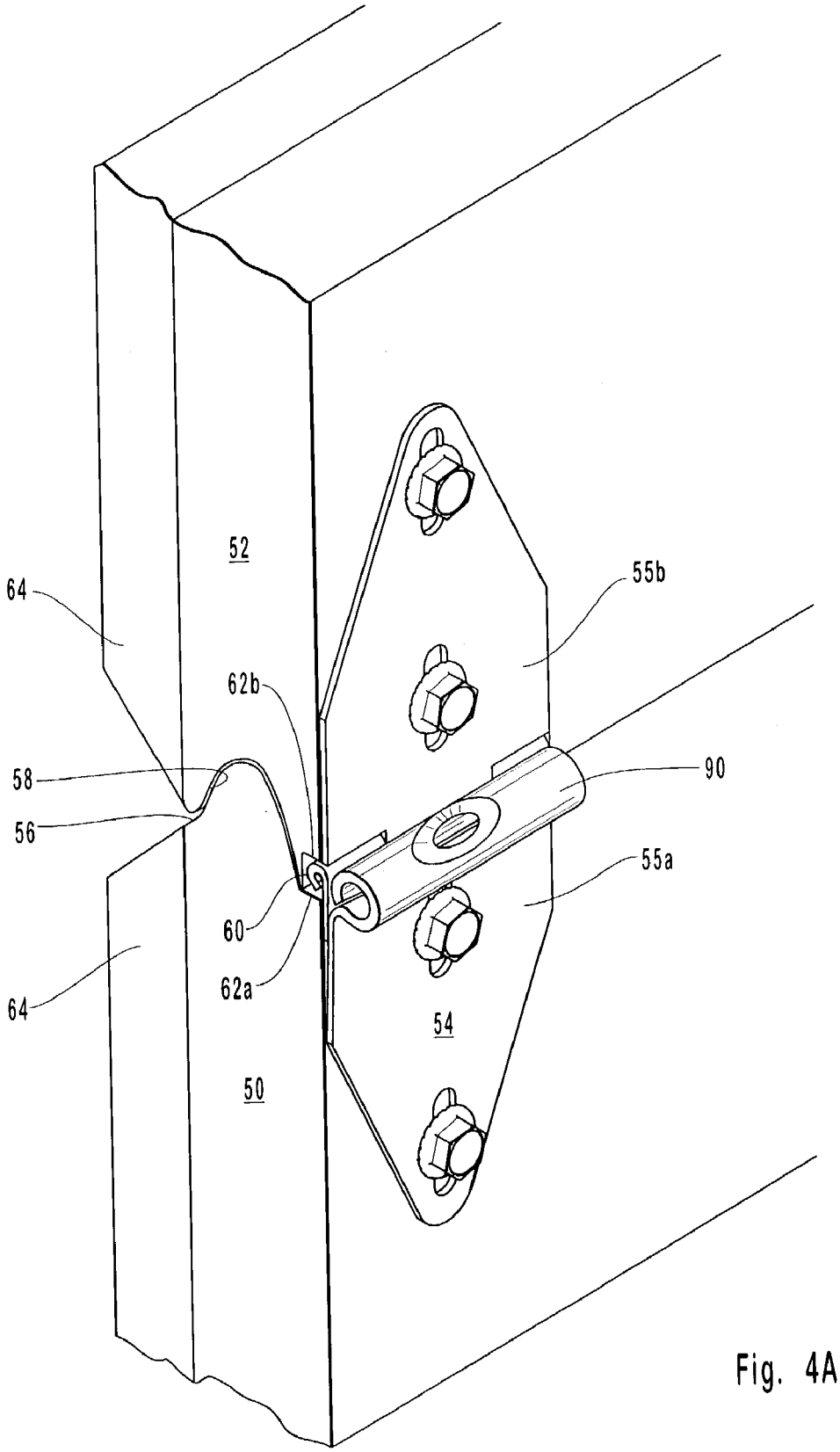
FIG. 4A provides a side perspective view illustrating a hinge coupled to two sections of a door in such a way as to enable one section of the door to support the weight of another section.

With reference now to FIG. 4A, a side perspective view of two panels and a corresponding hinge coupling the two sections of a door in such a way as to enable one section of the door to support the weight of another section is illustrated. In FIG. 4A, a first section 50 is configured to associate with a second section 52, wherein the sections are coupled together through the use of a hinge 54. In the illustrated embodiment, section 50 includes a contour 56 and the corresponding second section (section 52) includes a surface 58, wherein surface 58 corresponds to contour 56 so that as the sectional door follows a track system surface 58 follows the contour 56 to maintain a distance (joint gap) from the contour 56 that is within a particular range to prevent or reduce the risk of injury due to the joint gap.

Hinge 54 is a low profile hinge that is installed in a reverse position with the pivot point 60 in board. In a further embodiment, the pivot point is aligned with the back plane of the board. In the present invention, the panels include wood and are routed out to allow for the hinge pivot. Hinge 54 also included portion 90, which is configured to receive a shaft that is coupled to a wheel/disk. The seam between the panels that is located at the back plane of the door remains closed as the door opens, which adds strength to the low profile hinge during rough opening or closing of the door. Further, the closed seam creates a section to section support. The low profile hinge installed in a reverse position allows the hinge to be fastened to the door in-line with the closed section on the door face. In one embodiment, the hinge comprises ⅛" galvanized spring steel wire. In one embodiment, the door is a wood door that is approximately 2 inches thick.

In other embodiments of the present invention, a low profile hinge installed in a reverse position is used in association with other types of sectional doors, including metal sectional doors. Further, embodiments of the present invention embrace all panel door sizes.

In the present embodiment, the use and association of hinge 54 allows for a closed seam that provides strength to the door, as the door is supported on a panel on panel basis. In at least some embodiments, the hinge includes a flat arm and the pivot remains in contact during use. The hinge minimizes any joint gap, as will be further discussed below.

Figure 4B:
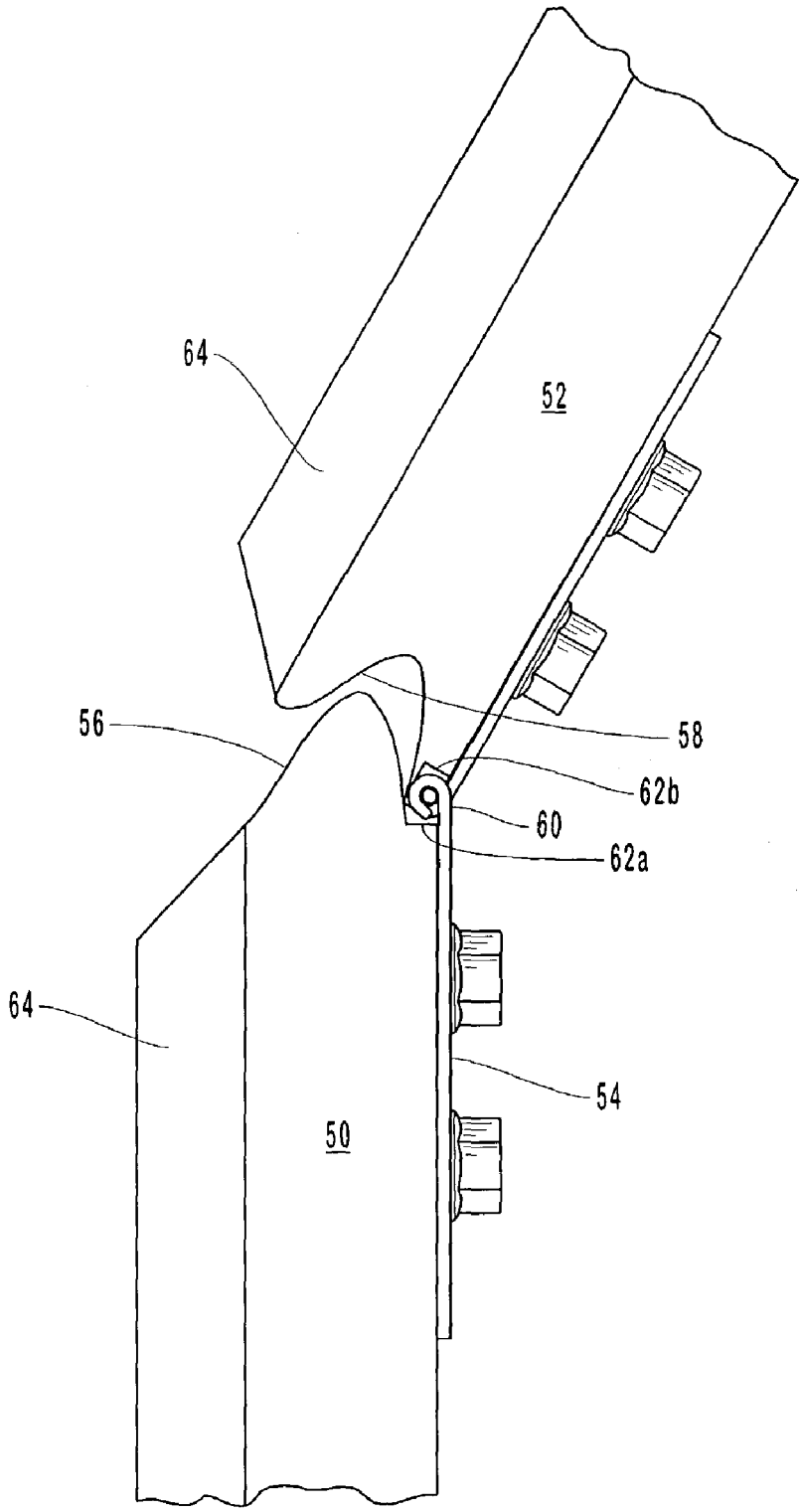
FIG. 4B provided a side view illustrating a minimized joint gap between two door panels.

With reference now to FIG. 4B, an end view is provided to illustrate how embodiments of the present invention minimize the space/gap between sections, wherein referred to as the joint gap. As provided above, a first section 50 is configured to associate with a second section 52, wherein the sections are coupled together through the use of a hinge 54. In the illustrated embodiment, section 50 includes a contour 56 and the corresponding second section (section 52) includes a surface 58, wherein surface 58 corresponds to contour 56 so that as the sectional door follows a track system surface 58 follows the contour 56 to maintain a distance (joint gap) from the contour 56 that is within a particular range to prevent or reduce the risk of injury due to the joint gap.

In one embodiment, the distance (joint gap) between the contour and the surface in the front of the door is approximately $1/4^{th}$ of an inch and the distance (joint gap) between the contour and the surface in the rear of the door is approximately 0 to $1/32^{nd}$ of an inch. This occurs, for example, when the curve includes a 12-inch radius and the rollers are 21 inches apart. Thus, great strength is provided to the section hinges of the door, rather than allowing joints to bend or collapse the hinges due to a heavy door. Accordingly, embodiments of the present invention enable the sections of the door to rotate in close proximity to each other. While the example provided above includes a front joint gap of approximately $1/4^{th}$ of an inch and a rear joint gap of approximately 0 to $1/32^{nd}$ of an inch, those skilled in the art will appreciate that embodiments of the present invention embrace a variety of contours and configurations to allow for a variety of joint gap sizes.

In a further embodiment, at least a portion a pivot point 60 of hinge 54 is located between opposing surfaces 62 of sections 50 and 52. The hinge 54 is used to secure the first section 50 to the second section 52. The pivot point 60 enables the sectional door to travel on a curvature of the track system. In a further embodiment, opposing surfaces 62 are formed to receive at least a portion of pivot point 60. Moreover, in one embodiment, the opposing surfaces touch hinge 54 to provide stability without causing the hinge to bind when in use. Since opposing surfaces 62 touch hinge 54, increased stability is provided to the sectional door. For example, if the pivot point 60 of hinge 54 were not between sections 50 and 52, and if a gap was located between the sections, all of the weight of the heavy door would be supported by the hinge. However, in accordance with the present invention, since opposing surfaces 62 touch hinge 54 and at least a portion of pivot point 60 is located between sections 50 and 52, the weight of one section (e.g., section 52) is supported by a corresponding lower section (e.g., section 50) and provides increased stability to the sectional door.

As the door travels the track system opposing surfaces 62 continually touch hinge 54 without causing any binding of the hinge. Accordingly, as the door travels the track system, the weight of the panels is supported by the hardware as well as by one section resting on another lower section. In this context, "resting" means weight applied at all times that reduces the sectional gap to a minimal measurement. Hinges on similar door sections support the weight of the door.

In FIG. 4B, the design appliqué (e.g., carriage house or another applique) is illustrated as appliqué 64. Further, hinge 54 is a low profile hinge. And, the association between sections 50 and 52 allow for minimum gap of 0.350" per DASMA standard 116 section 6 concerning finger entrapment in section joints. Moreover, the carriage house appliqué 64 is beveled to comply with DASMA standard 116 section 6 requirements.

Figure 5:
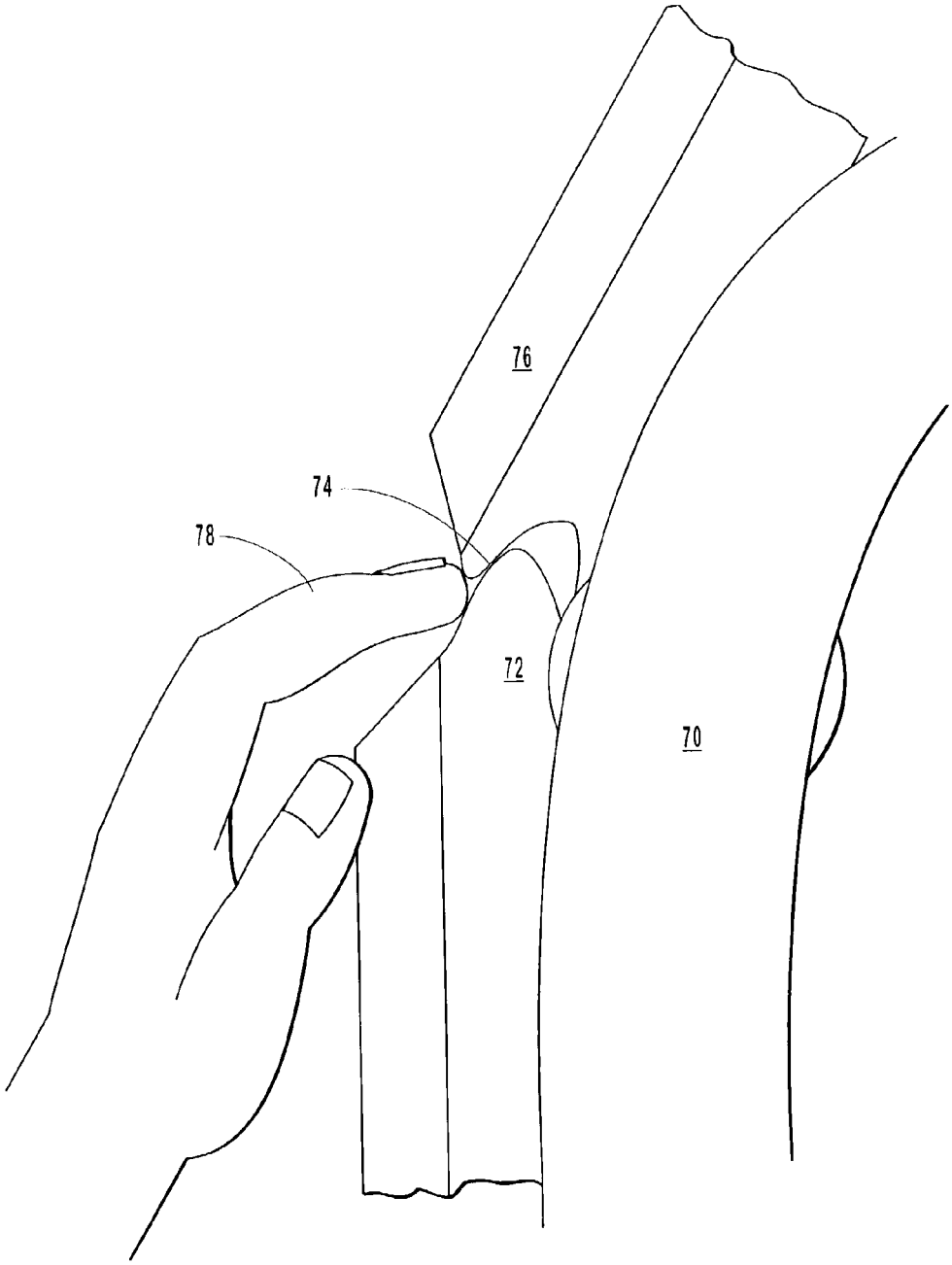
FIG. 5 provides another view of a joint gap created by an embodiment of the present invention as corresponding door sections follow a track system to raise or lower the sectional door.

With reference now to FIG. 5, an illustration is provided of another view of a joint gap created by an embodiment of the present invention as corresponding door sections follow a track system to raise or lower the sectional door. In FIG. 5, a portion of the track system includes a curvature 70 to enable the sectional door to move between open and closed positions. In the illustrated embodiment, a first section 72 includes a contour 74, and a second section 76 includes a surface having at least a portion thereof that follows the contour 74 as the sectional door travels through the curvature 70. The distance between the contour 74 and the surface is minimized in accordance with the present invention to prevent a finger 78 of an individual from entering into the joint gap and thereby being injured. The joint is radiused to match the motion of the hinge to allow for the sections to move in proximity to each other. In effect, the sections of the door rotate one within the other.

Figure 6:
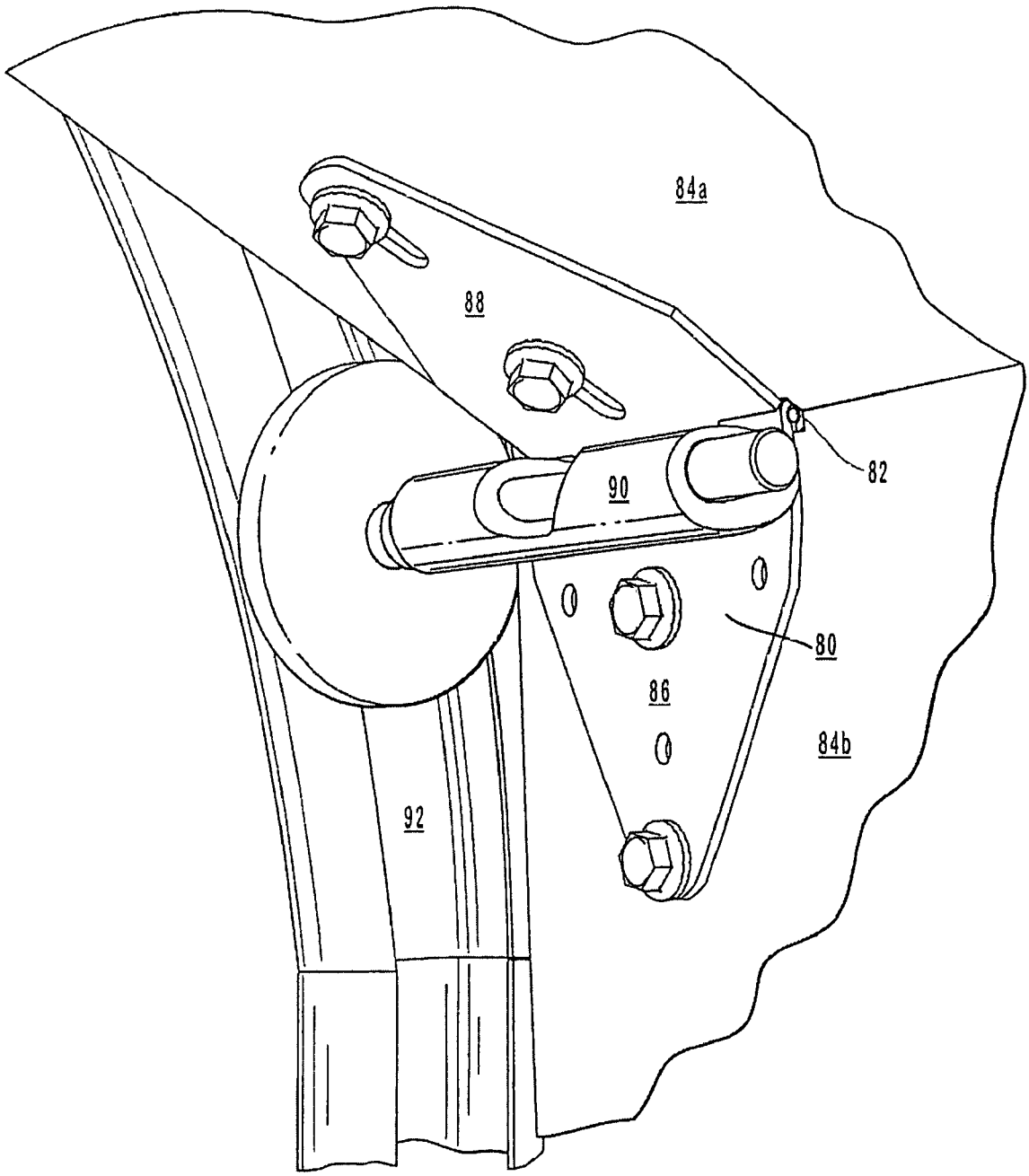
FIG. 6 provides a representative hinge used in accordance with the present invention to enhance strength and to reduce the amount of gap space created between corresponding sections of the door.

With reference now to FIG. 6, an illustration is provided of a representative hinge used in accordance with the present invention to enhance strength and to reduce the amount of gap space created between corresponding sections of the door. In FIG. 6, hinge 80 includes a pivot point 82, wherein at least a portion of the pivot point 82 is located between corresponding sections 84 of the door. In a further embodiment, a portion of the opposing ends are beveled to facilitate the location of at least a portion of the pivot point 82 between the corresponding sections 84.

In the illustrated embodiment, a first portion 86 of hinge 80 is mounted onto a back surface of section 84*b* and a second portion 88 of hinge 80 is mounted onto a back surface of section 84*a*. The hinge 80 illustrated in FIG. 6 is used near a track 92 and accordingly includes a portion 90 that is configured to receive a shaft that is coupled to a wheel, which rolls within track 92 to enable the sectional door to follow the track system.

Figure 7:
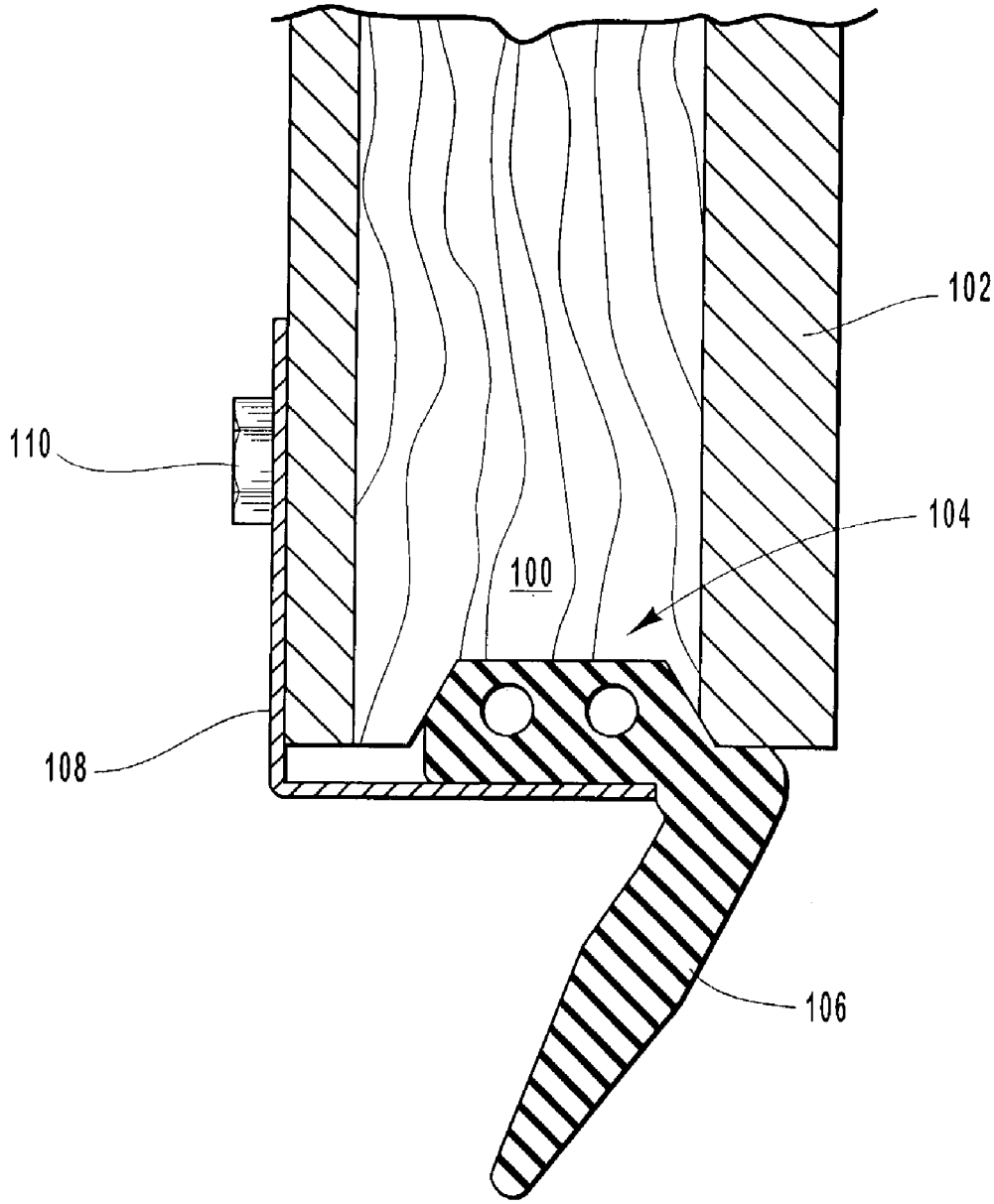
FIG. 7 illustrates a cross-sectional view of a bottom panel of a representative door in accordance with an embodiment of the present invention.

With reference now to FIG. 7, a cross-sectional view of a bottom panel of a representative door is illustrated in accordance with an embodiment of the present invention. In FIG. 7, panel 100 comprises wood and includes an appliqué 102, a receiving channel 104, and a stop 106, which prevents debris from going under a closed door. In the illustrated embodiment, receiving channel 104 includes a cross-sectional trapezoidal configuration. Stop 106 is received into channel 104 and secured by a brace 108 that is adhered to the door using a coupler 110. In some embodiments of the present invention, stop 106 includes a rubber or polymer material. Further, the stop may be used in association with any type of sectional door.

Embodiments of the present invention embrace sectional doors that no longer require customization, that reduce, minimize or eliminate joint gap space, that prevent warping due to the internal design, that provide strength by utilizing a panel on panel support, and/or utilize a stop that is used in association with a receiving channel.

Accordingly, as discussed herein, the present invention relates to sectional doors having a relationship and structure of and between door sections to enhance the safety and strength of the sectional doors. More particularly, the present invention relates to systems and methods for reducing gap space between sections of a door to enhance safety and to enable one section to support the weight of another section, wherein the support is beyond the strength of the hinge coupled to the two sections. In one embodiment, while the aesthetic design appears to be an appliqué,the design actually adds to the strength of the door since it is glued on, fastened, or otherwise mounted to help support the strength of the door. Furthermore, a combination of a contour and a surface that follows the contour minimizes the joint gap space and prevents injury. Also, a hinge having a pivot point between corresponding sections is used and minimizes any opening on the back side of the joint and the touching of the sections to the pivot point without causing any binding enables the weight of one section to be supported by another section of the door. Moreover, embodiments of the present invention are not limited by the size or weight of the sectional door.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A sectional door comprising:

a first section having a contour;

a second section having a surface corresponding to the contour, wherein the surface follows the contour during the time that the sectional door is in transition from one of:

(i) a closed position to an opened position; and (ii) the opened position to the closed position; and a low profile hinge having a pivot point, wherein the hinge couples the first section to the second section, wherein at least a portion of the pivot point is located between the first and second sections, and wherein a substantial portion of the length of the second section touches the first section during a substantial portion of the transition.

2. A sectional door as recited in claim 1, wherein the first and second sections comprise at least one of:

(i) wood;

(ii) metal; and (iii) plastic.

3. A sectional door as recited in claim 1, wherein the association of the contour and the surface minimizes gap space between the first and second sections.

4. A sectional door as recited in claim 1, wherein the second section supports to the first section when the door is in the closed position.

5. A sectional door as recited in claim 1, wherein the second section supports the first section when the door is in transition.

6. A sectional door as recited in claim 1, wherein a pivot point of the hinge is aligned with a back plane of the first section.

7. A sectional door as recited in claim 1, wherein the door is not custom made.

8. A sectional door as recited in claim 1, wherein the first section includes a receiving channel opposite the contour, wherein the receiving channel is configured to receive a stop.

9. A sectional door as recited in claim 8, wherein the receiving channel includes a trapezoidal cross-sectional configuration.

10. A sectional door comprising:

a first section coupled to a low profile hinge, wherein the first section includes a contour; and a second section coupled to the hinge, wherein the second section includes a surface that follows the contour of the first section as the hinge pivots, and wherein the hinge is coupled to the first and second sections such that at least a portion of a pivot of the hinge is located between the first and second sections without creating a gap that could pinch the finger of a user and wherein a substantial portion of the length of the second section touches the first section as the hinge pivots.

11. A sectional door as recited in claim 10, wherein a first opposing surface of the first section and a second opposing surface of the second section contact the pivot to enable the weight of the first section to be supported by the second section when the door is in a closed position.

12. A sectional door as recited in claim 10, wherein a constant association between the surface and the contour prevents entry of a finger between the first and second sections.

13. A sectional door as recited in claim 10, wherein the sectional door is a carriage house door.

14. A sectional door as recited in claim 10, wherein the first section includes a receiving channel opposite the contour, wherein the receiving channel is configured to receive a stop.

15. A sectional door as recited in claim 14, wherein the receiving channel includes a trapezoidal cross-sectional configuration.

16. A sectional door as recited in claim 10, wherein the first and second sections include an appliqué.

17. In a system that includes a sectional door having a front and a back and a track system to selectively transition the door between a closed position and an open position, a method for reducing the amount of joint gap space between sections of the door, the method comprising:

providing a first section having a contour;

providing a second section having a surface;

mounting a hinge to the first and second sections in a reverse position;

causing a substantial portion of the length of the second section to touch the first section as the hinge pivots; and causing a portion of the surface to follow the contour as the hinge pivots to minimize an amount of joint gap space located at the front of the door between the first and second sections.

18. A method as recited in claim 17, wherein the hinge is a low profile hinge, and wherein the mounting comprises mounting the low profile hinge in a reverse position to the first and second sections with the pivot of the hinge located between opposing surfaces of the first and second hinges to minimize an amount of joint gap space located at the back of the door between the first and second sections.

19. A method as recited in claim 18, wherein the amount of joint gap space located at the front of the door is between 0 inches to $1/16^{th}$ of an inch.

20. A method as recited in claim 19, wherein the amount of joint gap space located at the back of the door is between 0 inches to $1/16^{th}$ of an inch.

* * * * *